US006678906B1

(12) United States Patent
Thompson

(10) Patent No.: US 6,678,906 B1
(45) **Date of Patent: *Jan. 20, 2004**

(54) HYDROPHOBIC LAYERED BLANKET

(75) Inventor: Thomas L. Thompson, Balboa, CA (US)

(73) Assignee: Sleepmakers Incorporated, Balboa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/168,348

(22) PCT Filed: Apr. 30, 2002

(86) PCT No.: PCT/US02/13971

§ 371 (c)(1),
(2), (4) Date: Sep. 18, 2002

(87) PCT Pub. No.: WO03/092452

PCT Pub. Date: Nov. 13, 2003

Related U.S. Application Data

(63) Continuation of application No. 09/847,014, filed on Apr. 30, 2001, now Pat. No. 6,381,779.

(51) Int. Cl.[7] ..... A47G 9/02
(52) U.S. Cl. ..... 5/502; 5/484
(58) Field of Search ..... 5/417, 420, 502, 5/484, 699

(56) References Cited

U.S. PATENT DOCUMENTS

| | | | | |
|---|---|---|---|---|
| 3,081,517 A | | 3/1963 | Driesch | |
| 4,426,414 A | * | 1/1984 | Wilkerson | 428/102 |
| 4,777,681 A | | 10/1988 | Luck et al. | 5/464 |
| 5,427,834 A | | 6/1995 | Sodetz | 428/83 |
| 5,855,032 A | | 1/1999 | Field | 5/502 |
| 6,094,759 A | | 8/2000 | Thompson | 5/420 |
| 6,199,232 B1 | | 3/2001 | Kocivar | 5/502 |
| 6,212,711 B1 | | 4/2001 | Gilmour | 5/420 |
| 6,274,520 B1 | * | 8/2001 | Cordell | 442/381 |
| 6,381,779 B1 | | 5/2002 | Thompson | 5/502 |
| 2002/0004114 A1 | * | 1/2002 | Leaphart et al. | 428/36.1 |

* cited by examiner

*Primary Examiner*—Michael F. Trettel
(74) *Attorney, Agent, or Firm*—Drummond & Duckworth

(57) ABSTRACT

An improved blanket is provided having improved insulation, comfort, care and maintenance characteristics. The blanket is constructed of three layers of hydrophobic material which are secured together. Preferably, the layers of fabric are comprised of 100% polyester fleece fabric. The fixed proximity of three layers of polyester fleece fabric in a single blanket optimizes the extraordinary range of insulation capabilities of this unique, ultralight hydrophobic material.

2 Claims, 2 Drawing Sheets

HYDROPHOBIC LAYERED BLANKET

RELATED APPLICATIONS

The present application is a national stage application stemming from the filing of International Application Ser. No. PCT/US02/13971 filed on Apr. 30, 2002, which claims priority to and is a continuation of U.S. patent application Ser. No. 09/847,014 filed Apr. 30, 2001, now U.S. Pat. No. 6,381,779.

BACKGROUND OF THE INVENTION

The present invention relates to blankets. More particularly, the present invention relates to blankets constructed of fabrics which provide insulation, and thus warmth and protection to persons.

Blankets have remained substantially unchanged for thousands of years. Originally, blankets were constructed of animal skins, woven plant materials, and animal hair. Recently, blankets have been constructed of artificial materials such as polyester. Though the materials have changed, the particular constructions of the blankets have remained relatively unchanged. For example, the blanket industry uses standardized dimensions for its blankets, depending on the size of a bed on which a blanket is to be used.

Minor variations in these blankets have been recently developed to include changes in shape of the blanket and to construct the blanket with pockets or internal pillows. For example, U.S. Pat. No. 5,414,881 describes a blanket including an attached hood sized to receive a person's head to provide warmth and protection to a person's head. The blanket is then wrapped around a person to provide warmth and protection to the wearer's body. Meanwhile, U.S. Pat. Nos. 1,871,003, 5,179,741 and 5,481,768 describe blankets which include integrated pillows for providing cushioning to a person's head.

It has also been known to construct blankets including two layers of fabric. For example, the inventor of the present invention disclosed a blanket consisting of two pieces of polyester fleece fabric in U.S. Pat. No. 6,094,759. The two polyester fleece fabrics are secured together by an outer over-locked stitched edge and stitched fold lines.

Unfortunately, blanket manufacturers have been severely restricted in their ability to provide insulation, and thus maintain warmth of a person. A blanket manufacturer was previously provided the option of constructing a single layer blanket of a thicker material to provide additional insulation. In the alternative, a blanket manufacturer could construct a blanket of two layers of fabric with one or both layers being constructed of thicker materials to provide added insulation.

Unfortunately, previous blankets were not, and could not be, practically constructed of more than two layers. If any attempts to construct a blanket of three or more layers had been attempted, the manufacturer would discover that the blanket could not be used in moist environments and that it was extremely difficult to wash the blanket in water. The reason for this restriction is that previous blanket materials were primarily constructed of hydrophilic materials such as cotton or wool. As a result of the hydrophilic nature of these materials, any water that seeped into the interior layer or layers of the blanket was absorbed. This water would be difficult, if not impossible to remove from the interior layer, or layers, making the blanket ruined for its intended purpose.

As a result of the disadvantages of prior art blankets, it would be highly desirable to provide a blanket structure that could be easily manufactured that provides additional insulation to users.

SUMMARY OF THE INVENTION

Briefly, in accordance with the invention, I provide an improved blanket construction. The blanket is constructed of first, second and third layers of hydrophobic fabric. The three layers of fabric are secured together to create a single blanket. Preferably, the fabrics are secured together by stitching around the blanket's periphery. The stitching may be of any type known to those skilled in the art. In the preferred embodiments, the three layers of the blanket are secured together around the blanket's periphery by an over-locking stitching. In additional embodiments, the blanket's layers are secured together by traditional stitching patterns, such as four parallel sew lines extending longitudinally along the length of the blanket. The blankets may be constructed in any number of shapes. However, it is considered preferable that the blanket be constructed of three equal sized rectangular layers of fabric, as a rectangular shape is considered the most desired by blanket manufacturers and blanket users.

In the most preferred embodiment of the blanket of the present invention, the blanket is constructed of three layers of 100% polyester fleece fabric. Polyester fleece fabric is considered a true miracle of our time, and it has become popular for use in clothing and blankets for many years because of its outstanding qualities. Polyester fleece fabric is considered soft to the touch, warm and lightweight. It is also durable, and affordable. Moreover, because polyester fleece fabric is constructed of a synthetic fiber, it is virtually stain proof and easy to wash and dry in household cleaning appliances. However, for purposes of the present invention, polyester fleece fabric's most important advantage is that it is hydrophobic. More particularly, polyester fleece repels water causing moisture to be expelled into the atmosphere by capillary action. Moisture is literally pumped out of the polyester fleece fibers and replaced with air which acts as an excellent insulator. As a result of its hydrophobic properties, polyester fleece is unique among materials used in the blanket industry, including natural materials such as cotton, wool and down, and synthetic materials, notably acrylic fibers. All of these materials are hydrophilic, meaning that these fabrics absorb water which result in prior art blankets being poor insulators, particularly during moist or humid conditions.

It is thus an object of the present invention to provide an improved blanket which provides additional versatility and insulation, and can be constructed inexpensively.

It is an additional object of the invention to provide a blanket that is always warm and dry to the touch, even in moist environments.

Moreover, it is an object of the invention to provide a blanket which is washable and usable in moist conditions.

Finally, it is an object of the present invention to provide a blanket which is resistant to stains and which does not typically retain odors.

These and other objects and advantages have been accomplished with the construction and practice of the present invention, and these objects and advantages will be apparent to those skilled in the art from the following detailed description taken in conjunction with the drawings.

DETAILED DESCRIPTION OF THE INVENTION

Figure 1:
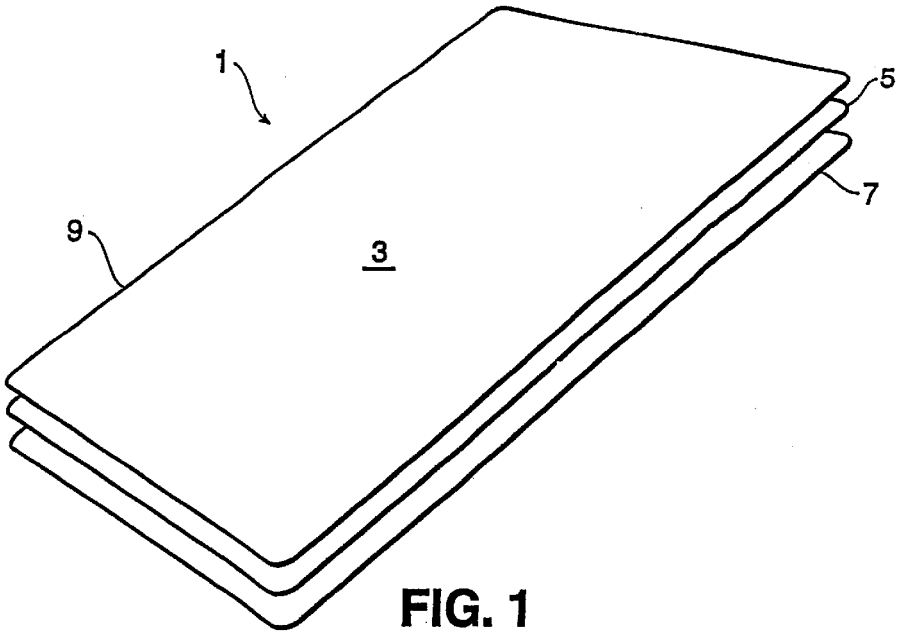
FIG. 1 is an expanded perspective view of the blanket of the present invention.
Figure 2:
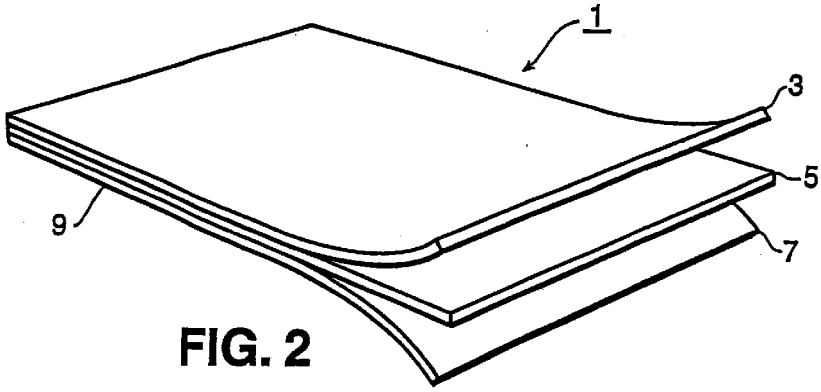
FIG. 2 is a perspective view of the blanket of the present invention illustrating that the blanket is constructed of three definite layers.
Figure 3:
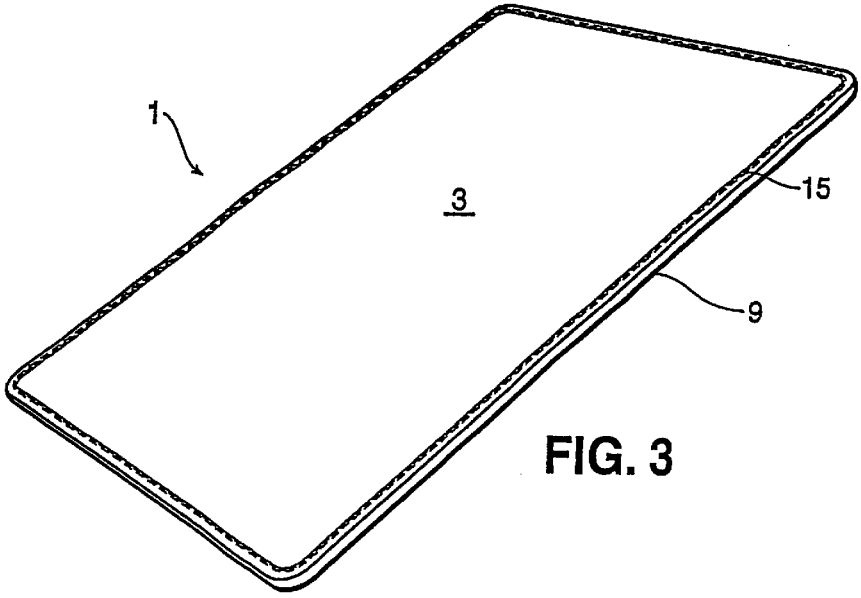
FIG. 3 is a perspective view of the blanket of the present invention wherein the three layers of the blanket are secured together by periphery stitching.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

Figure 4:
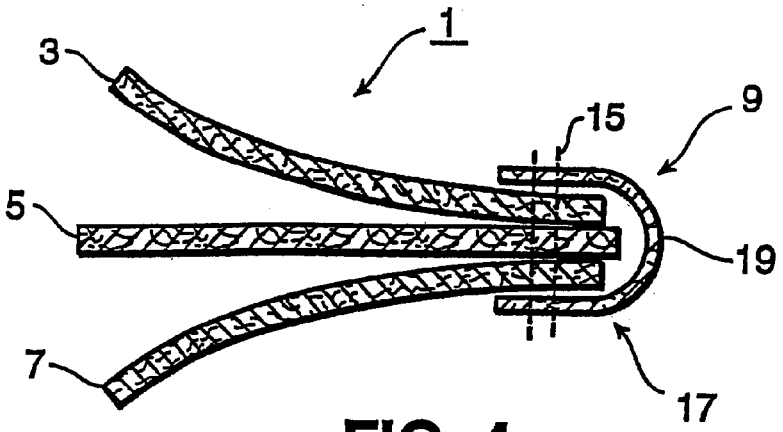
FIG. 4 is a cut-away side view of the blanket of the present invention illustrating the three layers of the blanket secured together by "welt" stitching at the blanket's periphery.
Figure 5:
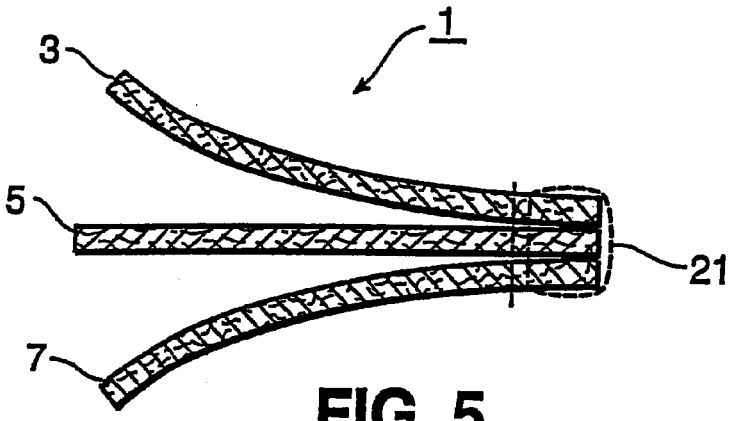
FIG. 5 is a cut-away side view of the blanket of the present invention illustrating the three layers of the blanket secured together by over-lock stitching at the blanket's periphery; and, FIG. 6 is a cut-away side view of the blanket of the present invention illustrating the three layers of the blanket secured together by additional traditional stitching at the blanket's periphery.
Figure 6:
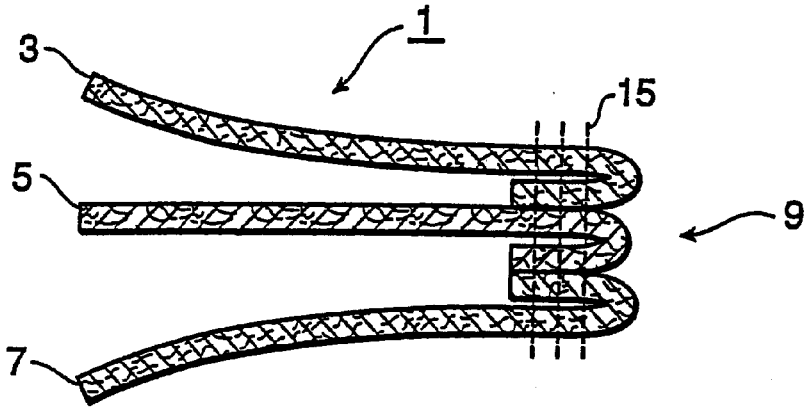

With reference to the figures, the blanket 1 of the present invention includes first, second and third layers of polyester fleece fabric, identified as elements 3, 5 and 7, respectively. Each of the three layers of fabric are constructed of hydrophobic materials. The three layers of fabric are secured together with the second hydrophobic fabric 5 being positioned between the first hydrophobic fabric 3 and the third hydrophobic fabric 7. The three layers of hydrophobic fabric may be secured together by any means known to those skilled in the art. For example, as shown in the figures, in a preferred embodiment the three layers of hydrophobic fabric 3, 5 and 7 are secured at the blanket's periphery 9 by stitching 15. For example, as shown in FIG. 4, in a preferred embodiment the layers of fabric are secured by "welt" stitching in which a small piece of edge fabric 19 is positioned to cover the ends of the layers of fabric to define the blanket's periphery 9. The position and construction of the edge fabric 19 reduces the propensity of the blanket to fray. In an alternative preferred embodiment, and as shown in FIG. 5, the edges of the layers of hydrophobic fabric may be secured by an over-lock stitching construction. Furthermore, as shown in FIG. 6, the periphery of the blanket may be secured together by stitching with the layers of fabric being folded inwardly to reduce the propensity of the blanket to fray. Though not shown in the figures, in addition to securing the layers of blanket together at the blanket's periphery, preferably the layers are secured together by four or more longitudinal or lateral sew lines. Of course, the layers of fabric of the blanket of the present invention may be secured together by numerous other means known to those skilled in the art without departing from the spirit and scope of the invention.

The blanket 1 may be constructed in enumerable shapes and sizes, depending on the purpose for which the blanket is intended to be used. Preferably, the blanket 1 is rectangular and constructed of three layers of fabric which are cut to size and secured together at the blanket's periphery. Moreover, the blanket is intended to be constructed for any use such as maintaining insulation and warmth to a person. Likewise, the blanket can be constructed for providing insulation to other animals, such as constructed as a horse blanket. In addition, it is intended that the blanket can be sized for any purpose, such as providing insulation to a child or infant in a crib, or constructed as a blanket for a king sized bed.

Preferably, the blanket 1 of the present invention includes three hydrophobic layers of fabric, each constructed of 100% polyester fleece fabric. Polyester fleece fabric is manufactured of polyester filament yarn fiber. There are several types of polyester fleece fabric known to those skilled in the art. The best known of the polyester fleece fabrics is a knitted fleece fabric having vertically oriented fibers. Polyester fleece fabric of this type is typically used for clothing apparel because it is very soft to the touch. A second type of polyester fleece fabric is constructed of horizontally oriented polyester filament yarn fibers. This second type of polyester fleece fabric is not knitted. Instead the polyester filament fibers are sinter laid and thermal bonded. Polyester fleece fabric having horizontally oriented fiber is commonly used for insulation as the horizontal orientation of the fibers traps more air than polyester fleece fabric having vertically oriented fibers. In addition, the horizontal orientation of the fibers allows the fabric to be more easily, and less expensively manufactured of greater thicknesses. Polyester fleece fabric is available from the Dupont® Corporation in variously constructed types of fibers including those sold under the trademarks Thermolite®, Quallofil® and Hollofil®, among others.

When a three layer polyester fleece blanket 1 of the present invention is used to cover a person, the blanket draws excess moisture from the person by capillary action. The capillary action causes warm dry air to be maintained within the blanket itself while cold moist air is maintained outside of the blanket. The moisture evaporates into the atmosphere as it moves to the exterior of the blanket walls, thereby trapping dry warm air within the blanket's fibers. The trapping of dry warm air within the blanket fibers creates a wall of insulation.

It has been discovered by the inventor that single or double layers of polyester fleece does not provide sufficient capillary action to provide comfort and warmth to satisfy most person's needs. It has been found that three layers of polyester fleece fabric provides increased insulation compared to one, or even two, layered polyester fleece blankets even of the same thickness. The unexpected synergism resulting from three layers of polyester fleece enables the construction of blankets having enhanced insulation characteristics, which can be constructed in an infinite number of variations depending on the user's needs. Three layers of fabric are also necessary to encapsulate the middle layer of the blanket where the middle layer is sinter laid horizontal fiber polyester fleece fabric.

For example, it is preferred that the two outer hydrophobic layers, 3 and 7 of the blanket 1 be constructed of 100% polyester fleece fabric having vertically oriented knit fibers. The vertical typed polyester fleece is softer to the touch and more comfortable to the skin, Meanwhile, it is preferred that the center hydrophobic layer be constructed of polyester fleece fabric having horizontal oriented fiber. The center layer can thus be constructed of greater thickness and with a large variety of fibers with specific purposes to provide greater insulation. By varying the thickness and type of the polyester fleece fabric of the center layer 3, the present invention can provide for a substantially similar blanket for those living in freezing climates as well as for those living in temperate climates.

Having described my invention in such terms as to enable those skilled in the art to make and use it, and having identified the presently preferred embodiments thereof, I claim:

1. A blanket comprising:

a first layer of a hydrophobic fabric constructed of polyester fleece fabric;

a second layer of a hydrophobic fabric constructed of polyester fleece fabric;

a third layer of a hydrophobic fabric constructed of polyester fleece fabric;

said first, second, and third layers of fabric secured together by stitching to create a single blanket.

2. A blanket comprising:

a first layer of a hydrophobic fabric constructed of vertically oriented polyester fleece fabric;

a second layer of a hydrophobic fabric constructed of horizontally oriented polyester fleece fabric;

a third layer of a hydrophobic fabric constructed of vertically oriented polyester fleece fabric;

said first, second, and third layers of fabric secured together by stitching to create a single blanket, with said second layer of hydrophobic fabric positioned between said first and third layers of hydrophobic fabric.

* * * * *